US011313056B2

(12) United States Patent
Peskowitz et al.

(10) Patent No.: US 11,313,056 B2
(45) Date of Patent: Apr. 26, 2022

(54) WOVEN GARMENT WITH GRIP YARNS

(71) Applicant: NIKE, Inc., Beaverton, OR (US)

(72) Inventors: Stephen Peskowitz, Beaverton, OR (US); Christopher J. Ranalli, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 419 days.

(21) Appl. No.: 15/993,168

(22) Filed: May 30, 2018

(65) Prior Publication Data

US 2019/0368082 A1 Dec. 5, 2019

(51) Int. Cl.

| | |
|---|---|
| ***D03D 15/00*** | (2021.01) |
| ***D03D 15/58*** | (2021.01) |
| ***A41B 1/00*** | (2006.01) |
| ***D03D 1/00*** | (2006.01) |
| ***D03D 15/46*** | (2021.01) |

(52) U.S. Cl.

CPC ..... *D03D 15/58* (2021.01); *A41B 1/00* (2013.01); *D03D 1/00* (2013.01); *D03D 15/46* (2021.01); *D10B 2331/02* (2013.01); *D10B 2331/04* (2013.01); *D10B 2501/04* (2013.01)

(58) Field of Classification Search

CPC ..... D03D 15/10; D03D 1/00; D03D 15/0088; D03D 15/58; D03D 15/46; D03D 15/33; A41B 1/00; D10B 2331/02; D10B 2331/04; D10B 2501/04; D10B 2501/00; D10B 2501/06

See application file for complete search history.

(56) References Cited

U.S. PATENT DOCUMENTS

| | | | | |
|---|---|---|---|---|
| 5,210,877 | A * | 5/1993 | Newman | A41D 1/067 2/456 |
| 6,247,179 | B1 * | 6/2001 | Underwood | A41D 31/085 2/81 |
| 6,708,342 | B2 | 3/2004 | Boersema | |
| 6,845,791 | B2 | 1/2005 | Schneider et al. | |
| 7,117,537 | B2 | 10/2006 | Mazzarolo | |
| 8,281,414 | B2 | 10/2012 | Mickle | |
| 8,397,315 | B2 | 3/2013 | Blakely et al. | |
| 8,510,864 | B2 | 8/2013 | Benini | |

(Continued)

FOREIGN PATENT DOCUMENTS

| | | |
|---|---|---|
| AU | 2004208684 C1 | 5/2012 |
| CN | 201250316 Y | 6/2009 |

(Continued)

OTHER PUBLICATIONS

International Search Report and Written Opinion dated May 28, 2019 in International Patent Application No. PCT/US2019/020928, 15 pages.

(Continued)

*Primary Examiner* — Robert H Muromoto, Jr.

(74) *Attorney, Agent, or Firm* — Shook, Hardy and Bacon LLP

(57) ABSTRACT

A woven panel is provided that utilizes "grip" yarns in the weft direction in a first area to increase the coefficient of friction of the woven panel. The grip yarns are interlaced with a plurality of non-grip yarns to form a repeating pattern of floats on the woven panel, that when sewn into a garment, provide additional traction and friction for securing the garment to a wearer's body.

13 Claims, 7 Drawing Sheets

(56) References Cited

U.S. PATENT DOCUMENTS

| | | | | |
|---|---|---|---|---|
| 8,539,616 | B2 | 9/2013 | Bland et al. | |
| 8,863,317 | B2 | 10/2014 | Tsuru et al. | |
| 9,456,641 | B1 | 10/2016 | Mignone | |
| 9,763,484 | B2 | 9/2017 | Conolly et al. | |
| 2005/0118913 | A1* | 6/2005 | Jen | D03D 15/49 442/181 |
| 2006/0272071 | A1* | 12/2006 | Mickle | A41D 13/0518 2/69 |
| 2008/0083055 | A1 | 4/2008 | Onda | |
| 2008/0235850 | A1 | 10/2008 | Cabauy et al. | |
| 2008/0256691 | A1 | 10/2008 | White et al. | |
| 2010/0000005 | A1 | 1/2010 | Dossman | |
| 2010/0186148 | A1 | 7/2010 | Crockett | |
| 2011/0016607 | A1* | 1/2011 | Ashmore | A41D 19/01547 2/159 |
| 2011/0111673 | A1* | 5/2011 | Soeda | D02G 3/406 450/1 |
| 2012/0085456 | A1* | 4/2012 | Guimbard | D03D 13/008 139/11 |
| 2013/0152268 | A1 | 6/2013 | Langdon | |
| 2015/0113717 | A1 | 4/2015 | Giron | |
| 2016/0286870 | A1* | 10/2016 | Capla | A41D 1/084 |
| 2017/0055600 | A1 | 3/2017 | Hawkins | |
| 2017/0233904 | A1* | 8/2017 | Weening | D03D 15/12 139/420 R |
| 2020/0170779 | A1* | 6/2020 | Tascan | D03D 13/008 |

FOREIGN PATENT DOCUMENTS

| | | | |
|---|---|---|---|
| CN | 106133223 | A | 11/2016 |
| CN | 106929974 | A | 7/2017 |
| GB | 2547006 | A | 8/2017 |
| JP | 5211210 | B2 | 6/2013 |
| WO | 2013098938 | A1 | 7/2013 |
| WO | 2016168160 | A1 | 10/2016 |

OTHER PUBLICATIONS

The Ultimate Travel Underwear featuring SmartGrip System, https://www.kickstarter.com/projects/yathletics/the-worlds-best-travel-underwear.com, Jun. 28, 2016, 12 pages.

GPM Custom Apparel, https://www.alebikewear.com/custom-apparel/gpm, 10 pages.

Under Armour Purestrike Grippy Fitted, https://www.underarmour.com/en-us/boys-ua-purestrike-grippy-fitted-long-sleeve/pid1285462-001.com, 2 pages.

NikeGrip Power Crew Socks—Red Lacrosse Socks, https://www.lax.com/lacrosse-equipment/nike-grip-power-crew-socks-red-2, 3 pages.

Specialty Yarn Families, http://www.tsiyarns.com/specialty-yarns.html, 2 pages.

International Preliminary Report on Patentability received for PCT Patent Application No. PCT/US2019/020928, dated Dec. 10, 2020, 9 pages.

* cited by examiner

WOVEN GARMENT WITH GRIP YARNS

TECHNICAL FIELD

The present invention relates to grip yarns woven as weft yarns and zonally placed on a woven panel, that when incorporated into a garment, provide additional traction and friction for securing the article to a wearer's body and/or to equipment being worn on the wearer's body.

BACKGROUND

Traditionally, woven or knit garments worn during athletic activity, such as a football jersey, lack gripping mechanisms to keep garments in place on the wearer and/or on equipment being worn by the wearer during movement.

BRIEF DESCRIPTION OF THE DRAWINGS

Examples of the present invention are described in detail below with reference to the attached drawing figures, wherein.

DETAILED DESCRIPTION

Figure 1:
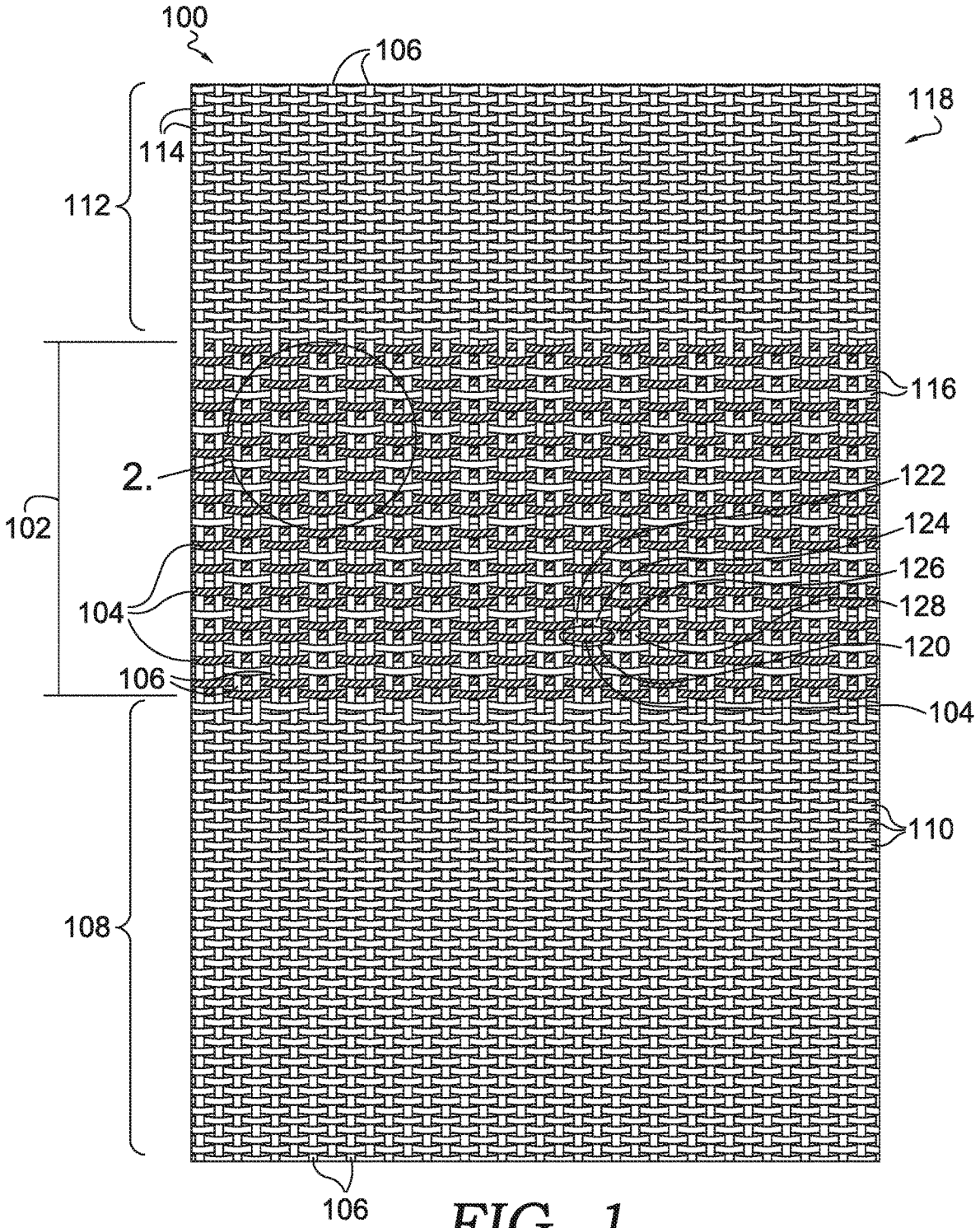
FIG. 1 illustrates a woven panel, in accordance with aspects herein.

The subject matter of the present invention is described with specificity herein to meet statutory requirements. However, the description itself is not intended to limit the scope of this disclosure. Rather, the inventors have contemplated that the disclosed and claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to woven garments with enhanced grip characteristics. In aspects, the woven garment incorporates yarns having a denier per filament less than or equal to about 0.01, which are known herein as grip yarns. As used herein, the term "about" means within ±5% of a given value. The grip yarns are woven in as weft yarns and are zonally placed on the garment in areas where increased friction may be needed. For example, in a football jersey, the grip yarns may be zonally placed in the chest, upper back, and shoulder areas so that the grip yarns come in contact with shoulder pads and keep the football jersey in place while worn during movement.

In aspects, woven garments described herein comprise at least a first area and a second area. The first area is formed from a first plurality of grip weft yarns, interlaced with a first plurality of non-grip warp yarns. The second area is formed from a second plurality of non-grip weft yarns, interlaced with the first plurality of non-grip warp yarns. There may also be a third area comprised of a third plurality of non-grip weft yarns interlaced with the first plurality of non-grip warp yarns. Additionally, the first area may further comprise a fourth plurality of non-grip weft yarns interlaced with the first plurality of non-grip warp yarns in the first area. While the first area may comprise both grip weft yarns and non-grip weft yarns, the percentage of grip weft yarns in the first area is greater than the non-grip weft yarns found in the first area, resulting in the first area having increased friction and traction, securing the garment to the wearer's body and to any equipment being worn thereon.

Further, in aspects, the non-grip weft yarns and the non-grip warp yarns described herein may comprise high tenacity yarn types such as, for example, high tenacity yarns formed from polyethylene terephthalate (PET). The use of high tenacity yarns types in the woven garments described herein may make the garment more suitable for physical activity sports that require a high amount of contact either between players or between the athlete and an athletic surface. One example sport may comprise, for example, football. Because high tenacity yarns are typically more resistant to breakage than normal yarn types, use of these in the garment may contribute to the garment being more durable and long-lasting.

Accordingly, aspects herein relate to a woven panel used to form an upper-body garment comprising a first surface and a second surface opposite the first surface. The woven panel further comprises a first area formed from a first plurality of weft yarns interlaced with a first plurality of warp yarns to form a repeating pattern of first floats on the first surface, the first plurality of weft yarns each having a denier per filament less than or equal to about 0.01. The woven panel additionally comprises a second area formed form a second plurality of weft yarns interlaced with the first plurality of warp yarns, the second plurality of weft yarns each having a denier per filament greater than 0.01.

Aspects herein are additionally directed to an upper-body garment comprising a torso portion comprising a front side, a back side, a first sleeve opening, a second sleeve opening, a neck opening, and a waist opening. The upper-body garment's first sleeve extends from the first sleeve opening and the second sleeve extends from the second sleeve opening. The upper-body garment further comprises a first area located between the neck opening and the first and second sleeve openings. The first area is formed from a first plurality of weft yarns interlaced with a first plurality of warp yarns to form a repeating pattern of first floats in the first area, and each of the first plurality of weft yarns has a denier per filament less than or equal to 0.01.

Aspects herein are further directed to a garment formed from a woven panel, the garment comprising a first area formed from a first plurality of first yarns interlaced with a first plurality of warp yarns to form a repeating pattern of first floats, the first plurality of weft yarns each having a denier per filament less than or equal to 0.01. Additionally, the garment comprises a second area formed from a second plurality of weft yarns interlaced with the first plurality of warp yarns to form a repeating pattern of second floats in the second area, wherein the second plurality of weft yarns each have a denier per filament greater than 0.01.

Positional terms as used herein to describe a garment such as "anterior," "posterior," "front," "back," "upper," "lower," "inner-facing surface," "outer-facing surface," and the like are with respect to the garment being worn as intended and as shown and described herein by a wearer standing in an upright position. Further, the phrase "configured to contact," or other similar phrases used when describing different portions of the garment or apparel item in relation to a wearer refer to a garment or apparel item appropriately sized for the particular wearer.

The term "yarn" as used herein may comprise any type of filament yarn such as a monofilament yarn or a multi-filament yarn that forms a continuous strand. The term yarn may also mean an assemblage of fibers twisted or laid together so as to form a continuous strand. The yarns may comprise synthetic yarns such as polyethylene terephthalate (PET) yarns, polyamide yarns, and natural yarns such as, for example, cotton. The term "polyamide" when describing yarns means a yarn having filaments formed from any long-chain synthetic polyamide. In the context of textiles, synthetic polyamides are commonly referred to as nylon.

Further, the term "high tenacity yarns" as used herein, means a yarn with significantly higher breaking tenacity than others in the same generic category. "Tenacity" is generally a measure of the strength of a yarn and is generally defined as the ability of a yarn to withstand a pulling force without breaking. In general, high tenacity yarns comprise synthetic fibers or filaments that have been strengthened by drawing or stretching the fiber/filament to align or orient the molecules to strengthen the intermolecular forces. Strengthening may also occur by chemical modifications during the polymerization process to increase molecular chain length. In an example aspect, the high tenacity yarns used herein may comprise PET yarn types. In example aspects, the high tenacity yarns described herein may have a tenacity from about 8.5 grams/denier (g/d) to about 10.0 g/d, from about 8.9 g/d to about 9.5 g/d, or from about 9.0 g/d to about 9.2 g/d. It is also contemplated herein that the high tenacity yarns may comprise a polyamide yarn type.

As well, the term "integral" as used herein means a textile having at least one textile element (e.g., yarn, fiber, or filament) that extends between different areas of a textile. For instance, with respect to the textile and garments described herein, the term integrally woven may mean the textile or garment has a continuous yarn, such as a warp yarn, that extends through different areas of the textile or garment. With respect to this aspect, the textile or garment has different areas or portions exhibiting different properties based on the yarn type found in each area and the varying percentage by weight of the yarn type in that area. This may be opposed to a panel type construction where two or more separate materials are joined by affixing edges or surfaces by, for example, stitching, bonding, adhesives, and the like, such that there is no continuity of a yarn or textile element between the two materials.

The term "float" as used herein may be defined as a yarn that crosses over more than one perpendicularly oriented yarn at a time before changing position to the other side or face of the textile. The term "warp yarn" as used herein refers to a yarn that is threaded through a loom in a woven fabric such that it is parallel to the selvage. The term "weft yarn" as used herein refers to a yarn that is perpendicular to the selvage of the woven fabric and that is interlaced with warp yarns.

The term "weaving" as used herein may mean a process by which yarns are interlaced at right angles. As used herein, the term "interlacing" may be defined as the point at which a yarn changes its position from one side or one face of the textile to the other side or other face of the textile. As used throughout this disclosure, the term "two-over-two interlacing" refers to a weaving structure in which a weft yarn is threaded over two warp yarns and then threaded under two adjacent warp yarns in a repeating pattern.

Continuing, the components of a woven panel described herein comprise warp yarns and weft yarns, where the warp yarns extend in the lengthwise direction of the woven panel and the weft yarns extend in the cross-wise direction of the woven panel (i.e., extend across the width of the woven panel). The woven panel, in aspects, may be woven during a single weaving event. As such, a particular warp yarn may extend the length of the woven panel. The present disclosure contemplates a number of different types of looms used to weave the woven panel such as air-jet looms, rapier looms, water-jet looms, projectile looms, multi-width or multi-beam looms, multiple-shed looms, circular looms, Jacquard looms, and the like.

As used herein, the term "grip yarns" as used herein means yarns having a single yarn strand that may comprise up to 7000 or greater number of filaments such that the denier per filament of the single yarn strand is less than or equal to about 0.01. In aspects, the grip yarn may comprise PET (commonly known as polyester). The large number of filaments provides a large surface-to-volume ratio for the single yarn strand which contributes to the gripping function of the yarn. To describe it differently, the large number of filaments within the single yarn strand causes the single yarn strand to have a higher coefficient of friction as compared to, for example, more typical yarns that incorporate a smaller number of filaments within a single yarn strand such as yarns that incorporate from between, for example, 50 filaments to 500 filaments per single yarn strand. The term "non-grip yarn" as used herein means a yarn having a single yarn strand that may comprise less than 7000 filaments so that the denier per filament of the single yarn strand is greater than about 0.01.

Turning now to FIG. 1, a woven panel 100 comprising a first surface 118 is shown in accordance with aspects herein. For discussion purposes herein, the first surface 118 will generally be referred to as the portion of the woven panel 100 which faces away from the wearer's body surface when the woven panel 100 is formed into a garment and the garment is donned (otherwise known as an "outer-facing surface"), and a second surface (not shown in FIG. 1) will generally be referred to as the portion of the woven panel 100 which faces a wearer's body when the woven panel 100 is formed into the garment and the garment is donned (otherwise known as an "inner-facing surface").

As described herein, the woven panel 100 is constructed through a weaving process. The woven panel 100 comprises a first area 102 formed from a first plurality of grip weft yarns 104 (shown with hatching), interlaced with a first plurality of non-grip warp yarns 106 (shown without hatching) and a second area 108 formed from a second plurality of non-grip weft yarns 110 (shown without hatching), interlaced with the first plurality of warp yarns 106 (shown without hatching), in accordance with aspects herein. In aspects, the grip weft yarns 104 comprise a PET yarn type while the non-grip weft yarns 110 comprise one of polyamide yarns or PET yarns. The warp yarns 106 are continuous lengthwise throughout the woven panel 100 and may be formed from non-grip PET yarns. Both the non-grip weft and warp yarns discussed herein may also be comprised of high tenacity yarns.

The woven panel 100 of FIG. 1 further comprises a third area 112 formed from a third plurality of non-grip weft yarns 114 (shown without hatching), interlaced with the first plurality of warp yarns 106. In an aspect, the second area 108 comprised of the second plurality of non-grip weft yarns 110 and the third area 112 comprised of the third plurality of non-grip weft yarns 114 may be formed from the same or different yarn types. For example, in some aspects, the second plurality of non-grip weft yarns 110 may be formed from polyamide yarns while the third plurality of non-grip weft yarns 114 may be formed from polyethylene terephthalate (PET) yarns, or vice versa. In an aspect, the third plurality of non-grip weft yarns 114 may comprise high tenacity yarns.

As seen in FIG. 1, the first area 102 further comprises a fourth plurality of non-grip weft yarns 116 (shown without hatching), that are interlaced with the first plurality of warp yarns 106. The fourth plurality of non-grip weft yarns 116 may be formed from polyamide yarns or PET yarns. As well, the fourth plurality of non-grip weft yarns 116 may comprise high tenacity yarns.

In an example aspect, while the first area 102 comprises both the first plurality of grip weft yarns 104 and the fourth plurality of non-grip weft yarns 116, the first area 102 comprises a greater percentage of the grip weft yarns 104 compared to the fourth plurality of non-grip weft yarns 116. In other words, the first area 102 is comprised of greater than about 50% grip weft yarns 104, resulting in the first area 102 having a relatively greater coefficient of friction that, for instance, the second area 108 and the third area 112. This, in turn, facilitates the first area 102 providing greater friction and gripping to a surface that the grip weft yarns 104 are in contact when the woven panel 100 is incorporated into a garment.

Further, as shown in FIG. 1, the first area 102 of the woven panel 100 is positioned between the second area 108 and third area 112 (i.e., the first area 102 separates the second area 108 from the third area 112). When the woven panel 100 is constructed into an upper-body garment, the patterning of the woven panel 100 is such that the second area 108 is positioned on the front of the garment, the third area 112 is positioned on the back of the garment, and the first area 102 may be positioned so that it is partly on the front and partly on the back of the garment with respect to the shoulder region of the garment.

FIG. 1 also depicts each of the grip weft yarns 104 extending over two warp yarns, such as warp yarns 122 and 124 of the first plurality of warp yarns 106 to form a repeating pattern of first floats 120 on the first surface 118. The grip weft yarns 104 then extend under the next two warp yarns, such as warp yarns 126 and 128 to form a repeating pattern of floats on the second surface (not shown). The same weaving pattern may be used for the non-grip weft yarns 116. In one example, the grip weft yarns 104 and the non-grip weft yarns 116 are woven in a 2×2 twill pattern.

Figure 2:
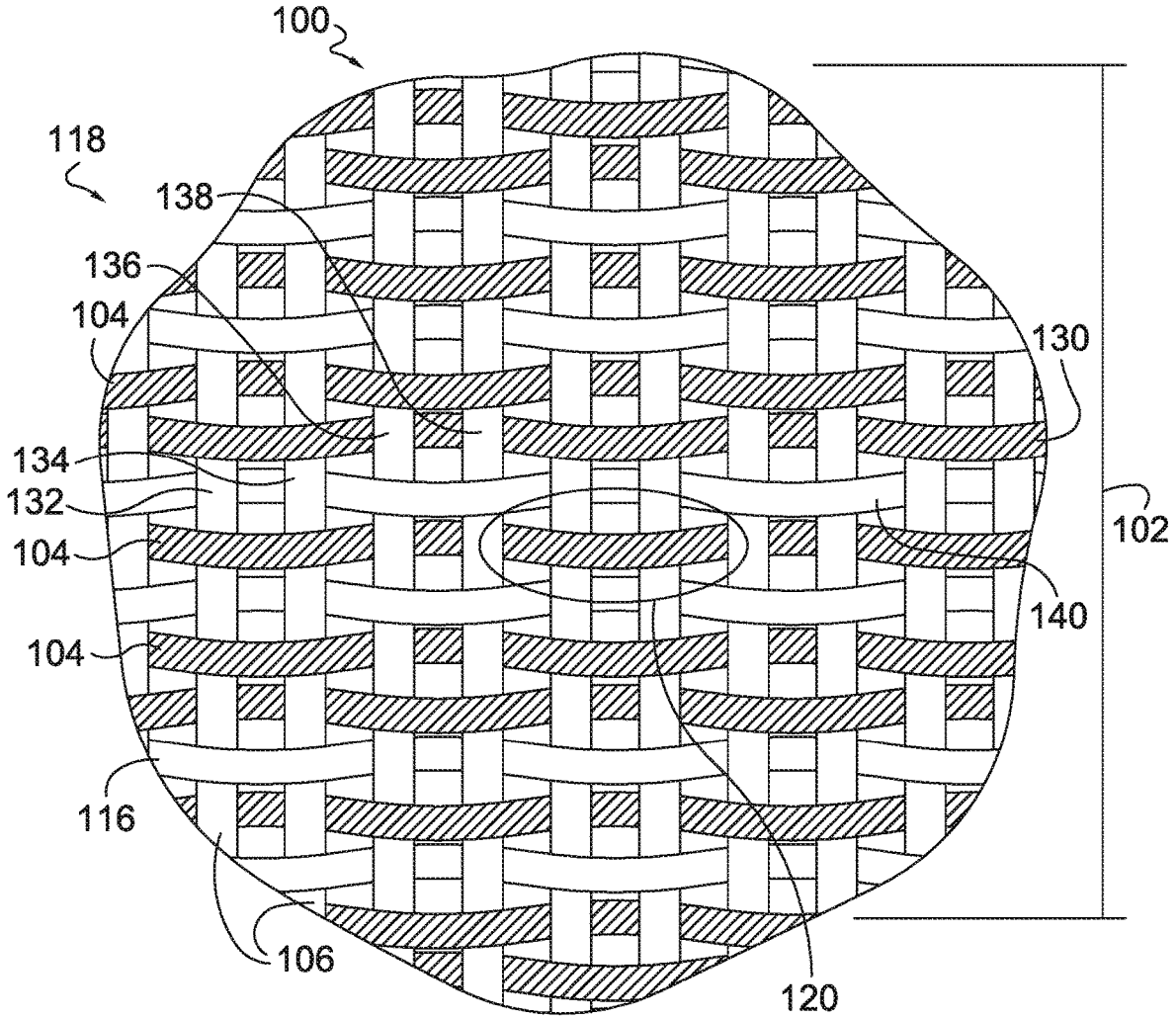
FIG. 2 illustrates a magnified view of a first surface of the woven panel of FIG. 1 taken at the area indicated in FIG. 1, in accordance with aspects herein.
Figure 3:
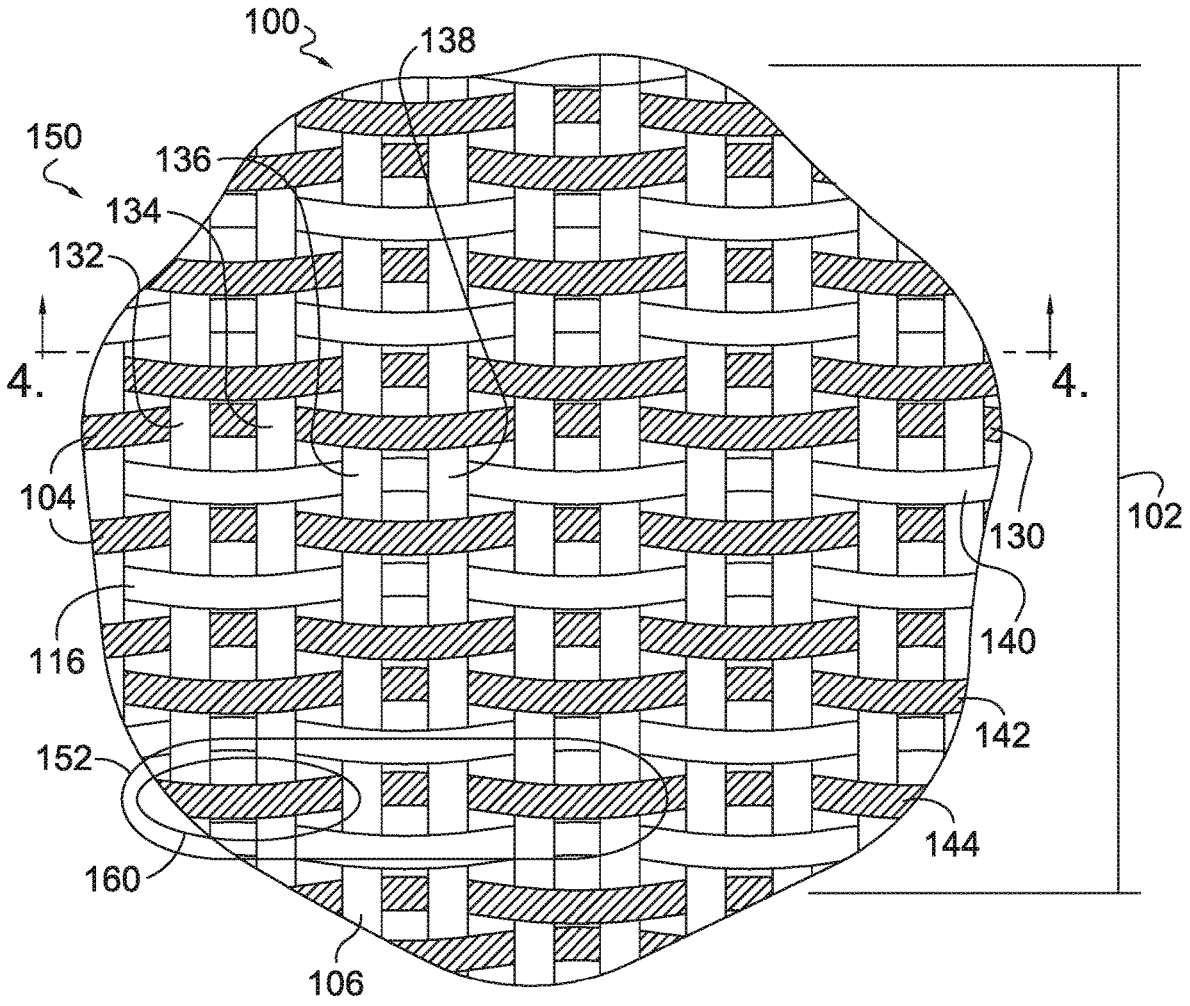
FIG. 3 illustrates a magnified view of a second surface of the woven panel of FIG. 1 where the area corresponds to that shown in FIG. 2, in accordance with aspects herein.

Next, FIGS. 2-3 respectively illustrate a magnified view of the first surface 118 of the first area 102 of the woven panel 100 and a second surface 150 of the first area 102 of the woven panel 100 of FIG. 1. As described herein, the woven panel 100 is constructed through a weaving process. FIGS. 2-3 more clearly depict each of the first plurality of grip weft yarns 104 (shown with hatching) extending over two warp yarns of the first plurality of warp yarns 106 to form the repeating pattern of first floats 120 on the first surface 118. Then, each of the first plurality of grip weft yarns 104 extends under the next two warp yarns 106 and to form a repeating pattern of floats 160 on the second surface 150 (seen in FIG. 3). For example, with respect to FIG. 2, weft yarn 130 extends over warp yarns 132 and 134 and then under warp yarns 136 and 138 in a repeating pattern in the first area 102. Next, with respect to FIG. 3, the grip weft yarn 130 is shown extending under warp yarns 132 and 134 and then extending over warp yarns 136 and 138.

Similarly, the fourth plurality of non-grip weft yarns 116 (shown without hatching) are interlaced with the first plurality of warp yarns 106, where each of the fourth plurality of non-grip weft yarns 116 extends over two warp yarns 106 and then under two warp yarns 106 to form a repeating pattern of floats. For instance, with respect to FIG. 2, non-grip weft yarn 140 extends under warp yarns 132 and 134 and then over warp yarns 136 and 138. And with respect to FIG. 3, the non-grip weft yarn 140 extends over warp yarns 132 and 134 and under warp yarns 136 and 138. This repeating pattern continues the width of the woven panel 100.

By floating at least the grip weft yarns 104 on the first surface 118 of the first area 102 of the woven panel 100, the grip weft yarns 104 comprise a greater percentage of the surface area of the first surface 118 at the first area 102 as compared to, for instance, a one-over-one interlacing pattern for the grip weft yarns 104. In other words, the result of the weaving pattern show in FIGS. 1-3 is that a greater surface area of the grip weft yarns 104 is exposed on the at least first surface 118 of the first area 102 as opposed to a one-over-one interlacing pattern in which the surface area of the grip weft yarns 104 would be reduced.

A functional benefit achieved by having a greater percentage of grip weft yarns 104 versus non-grip weft yarns 116 and by using a weave pattern that floats the grip weft yarns 104 in the first area 102 of the woven panel 100 (seen in FIGS. 1-3), is that the first area 102 may have a higher coefficient of friction as compared to, for example, the second area 108 and the third area 112 that do not incorporate grip weft yarns 104.

Figure 4:
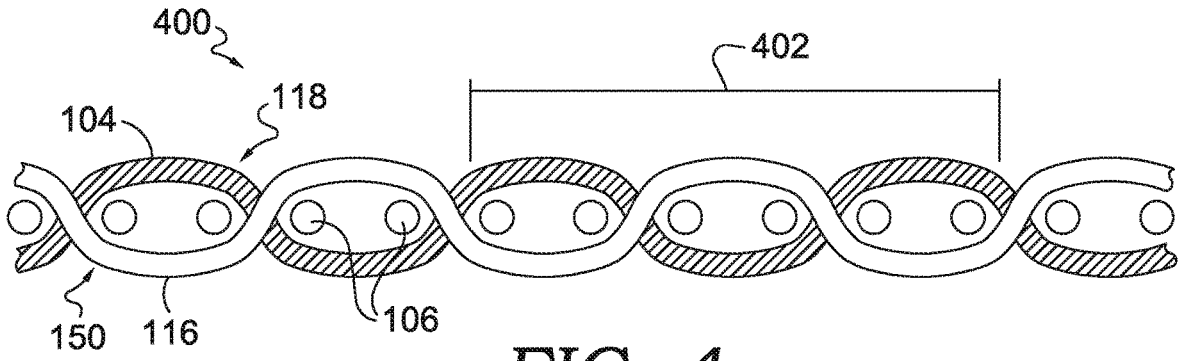
FIG. 4 illustrates an example weaving diagram of the woven panel of FIG. 1 taken at the area indicated in FIG. 3, in accordance with aspects herein.

Turning next to FIG. 4, an example weaving diagram 400 of the woven panel 100 taken at the area indicated in FIG. 3 is shown. The weaving diagram 400 is depicted as a cross-sectional view cut parallel to the weft yarns 104 and 106. The weft yarns comprise the grip weft yarns 104 and the fourth plurality of non-grip weft yarns 116 both of which are interlaced with the first plurality of warp yarns 106. The grip weft yarns 104 are woven in a repeating pattern 402 such that the grip weft yarn 104 passes over (or floats over) two adjacent warp yarns 106 on the first surface 118 of the woven panel 100 before traveling to the second surface 150 of the woven panel 100. Then the grip weft yarn 104 passes under a next set of two adjacent warp yarns 106 on the second surface 150. The result of the weave pattern is that the grip weft yarns 104 are woven in the inverse pattern on the second surface 150 (seen in FIG. 3).

Figure 5:
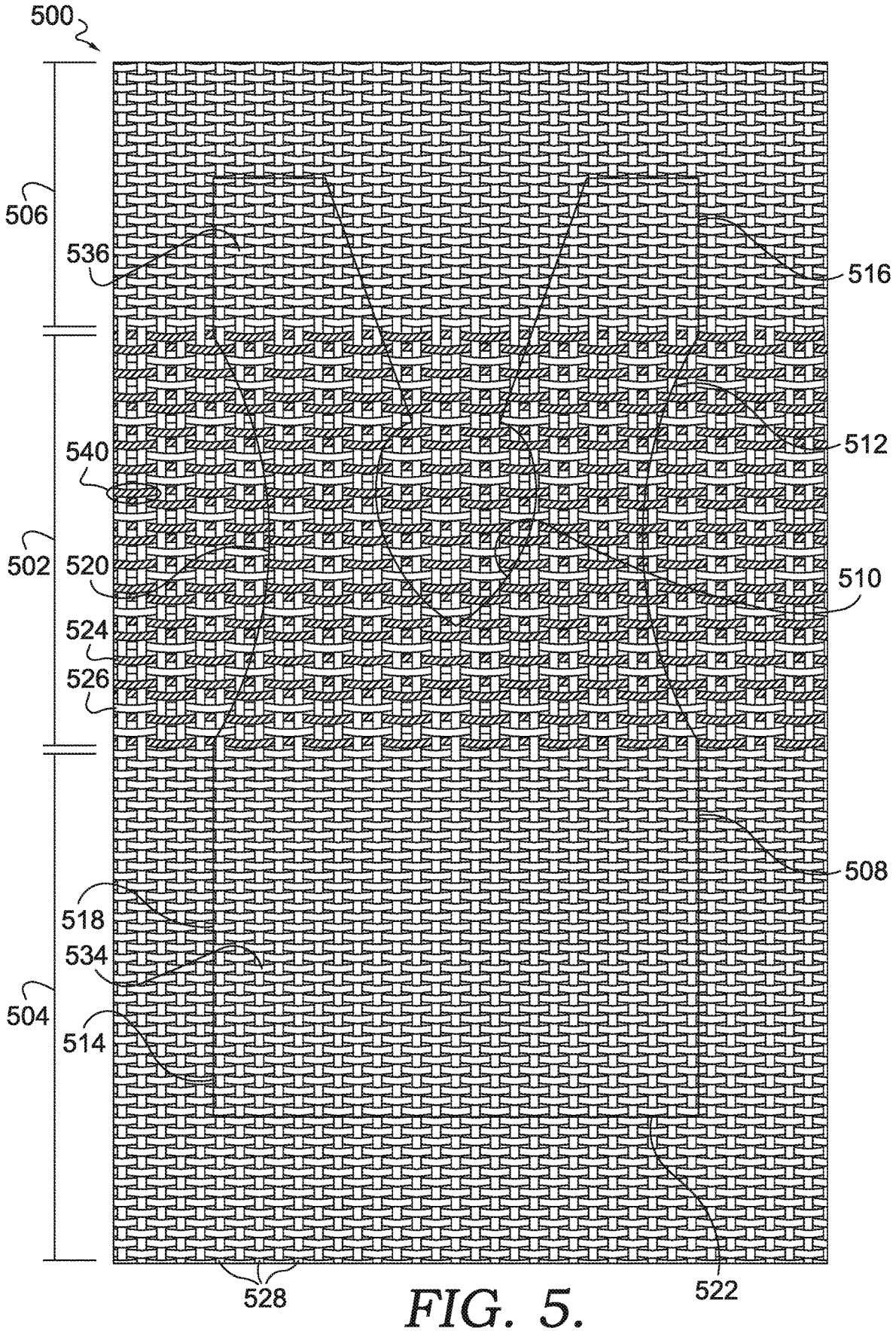
FIG. 5 illustrates a pattern piece superimposed on a woven panel, in accordance with aspects herein.

Continuing on with FIG. 5, a woven panel 500 comprising a first area 502, second area 504, a third area 506 and a pattern piece 508, in accordance with aspects herein is shown. In one example, the woven panel 500 may comprise the woven panel 100, and, as such, much of the description of the woven panel 100 is equally applicable to the woven panel 500.

The pattern piece 508 depicted on the woven panel 500 in FIG. 5 is superimposed over the woven panel 500 and designed for the formation of an upper-body garment. The pattern piece 508 includes a neck opening 510, two sleeve openings 512 and 520, a torso portion 514, and back portion or back side 516. After the woven panel 500 is cut according to the pattern piece 508, an upper-body garment may be formed such that the upper-body garment comprises the torso portion 514 having a front side 518, the back side 516, the first sleeve opening 512, the second sleeve opening 520, the neck opening 510, and the waist opening 522. While FIG. 5 depicts the pattern piece 508 on the woven panel 500 that forms an upper-body garment when formed, it is contemplated that pattern pieces for other types of garments, such as a lower-body garments, may also be superimposed on woven panel 500. Moreover, it is contemplated herein that there may be one or more additional pattern pieces (not shown) that may be used to finish the construction of the upper-body garment. For instance, there may be pattern pieces for sleeves and one or more pattern pieces that may be used to complete the back side 516 of the upper-body garment. Any and all aspects, and any variation thereof, are contemplated as being within aspects herein.

As seen in FIG. 5, the first area 502 comprising the both the grip weft yarns 524 (shown with hatching) and the fourth plurality of non-grip weft yarns 526 (shown without hatching) are located in the region of the pattern piece 508 that when cut and formed, will be the neck, shoulders, front upper region/chest area, and upper back area of the garment. The first area 502 comprises grip weft yarns 524 and the fourth plurality of non-grip weft yarns 526 interlaced with the first plurality of warp yarns 528. As previously described, the first area 502 comprising a greater percentage of grip weft yarns 524 than the fourth plurality of non-grip weft yarns 526 and the repeating pattern of first floats 540 create an area of increased friction for securing a resulting garment to the wearer's body and/or to equipment being worn by the wearer. For example, in a football jersey, the first area 502 comprising the grip weft yarns 524 would be in contact with underlying shoulder pads and the grip weft yarns 524 may facilitate keeping the jersey in place with respect to the shoulder pads while the player is moving and/or participating in athletic activities such as football.

In example aspects, the second area 504 and the third area 506 do not comprise grip weft yarns 524. Instead, the second area 504 and the third area 506 respectively comprise a second plurality of non-grip weft yarns 534 and a third plurality of non-grip weft yarns 536 that are interlaced with a first plurality of warp yarns 528. In an example aspect, the second area 504 and third area 506 may comprise a mock leno weave, which may enhance air permeability in these areas.

Figure 6:
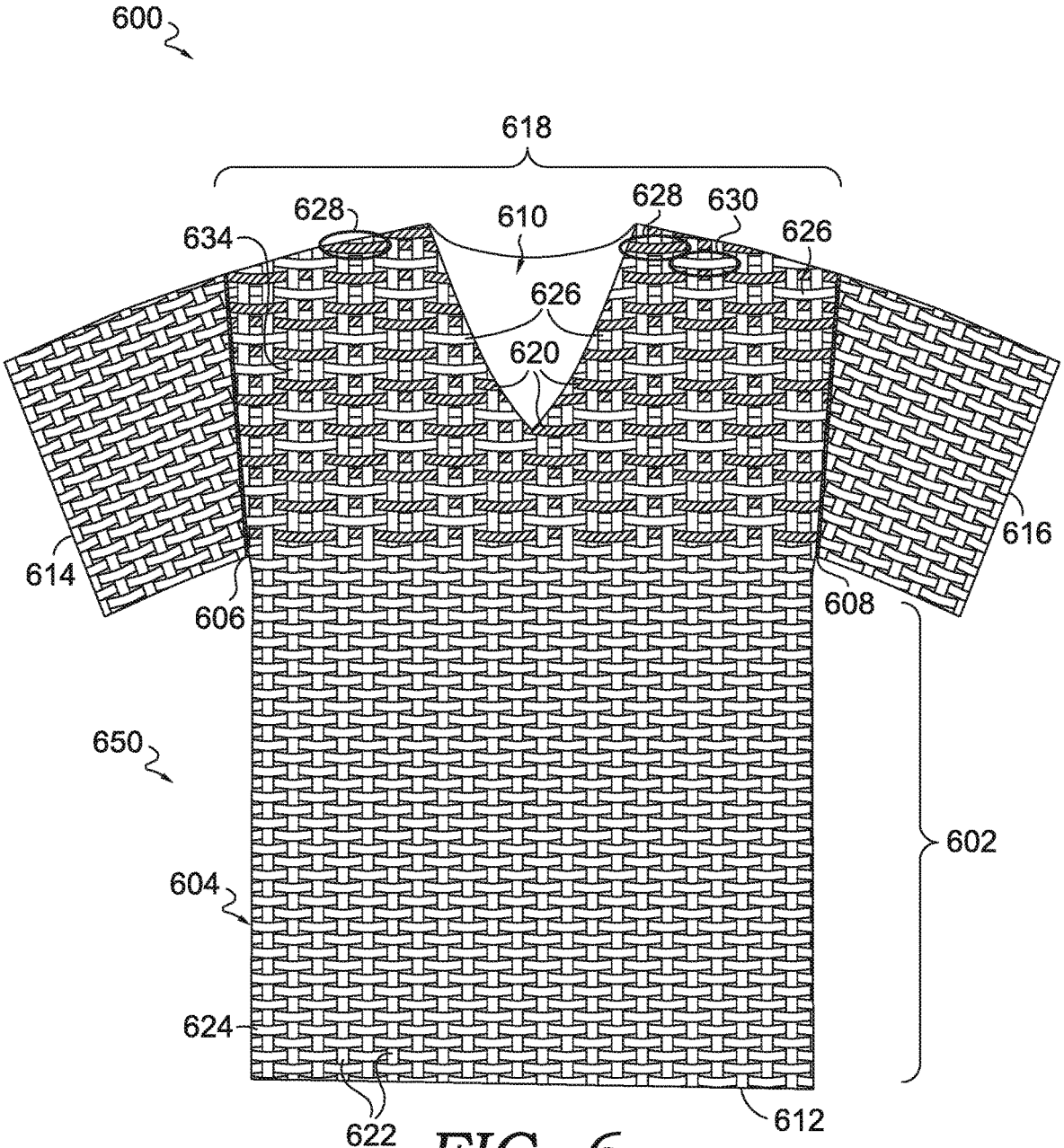
FIG. 6 illustrates a front view of a woven upper-body garment formed from the woven panel of FIG. 1, in accordance with aspects herein.
Figure 7:
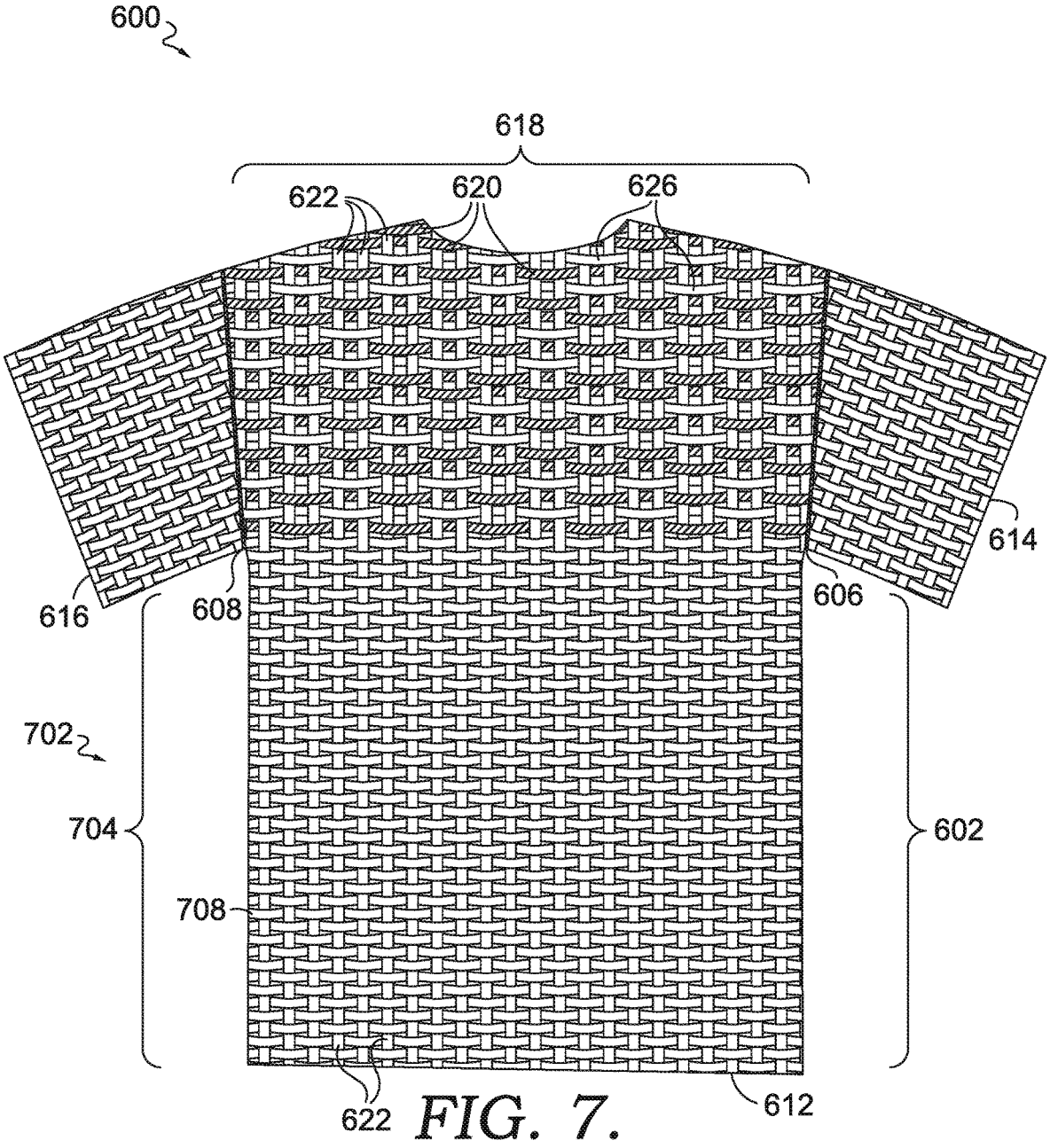
FIG. 7 illustrates a back view of the woven upper-body garment of FIG. 6, in accordance with aspects herein.

Next, FIGS. 6-7 respectively illustrate a front view of a woven upper-body garment 600 and a back view of the woven upper-body garment 600 in accordance with aspects herein. The woven upper-body garment 600 may be formed from the woven panel 100 or the woven panel 500. Moreover, the upper-body garment 600 may have a general shape corresponding to the pattern piece 518 although it is contemplated that the upper-body garment 600 may comprise additional pieces to fully form the garment 600 (e.g. sleeves). The woven upper-body garment 600 is shown in the form of a short sleeve tee shirt or a jersey, but it is contemplated herein that the garment 600 may be in the form of a lower-body garment, a whole body garment, and the like. Moreover, although shown in the form of a short sleeve shirt, the woven upper-body garment 600 may take other forms such as a jacket, pull-over, a hoodie, a vest, sleeveless shirt, and the like. Any and all aspects, and any variation thereof are contemplated as being within aspects herein.

The woven upper-body garment 600 comprises a torso portion 602 comprising a front side 604 and a back side 702. Additionally, the woven upper-body garment 600 comprises a first sleeve 614 extending from a first sleeve opening 606 and a second sleeve 616 extending from a second sleeve opening 608. Further, the woven upper-body garment 600 comprises a first area 618 that is located generally horizontally between the first sleeve opening 606 and the second sleeve opening 608. The first area 618 may, for example, extend about one-third of the distance from the top of the first sleeve opening 606 and second sleeve opening 608 to the waist opening 612 on both the front side 604 and back side 702 of the upper-body garment 600. In other aspects, the first area 618 may extend about one-fourth or one-half of the distance from the top of the first sleeve opening 606 and second sleeve opening 608 to the waist opening 612 on both the front side 604 and back side 702 of the upper-body garment 600. Further, while the first area 618 is depicted as being located between the first sleeve opening 606 and the second sleeve opening 608 in FIGS. 6-7, in other aspects, it is contemplated that the first area 618 may extend onto both the first sleeve 614 and the second sleeve 616. In other words, it is contemplated herein that the first sleeve 614 and the second sleeve 616 may comprise the same woven construction as the first area 102 of the woven panel 100 or the first area 502 as the woven panel 500. Still further, it is contemplated herein that the first sleeve 614 and the second sleeve 616 may integrally extend from the torso portion 602.

The first area 618 is formed from a first plurality of grip weft yarns 620 (shown with hatching) interlaced with a first plurality of warp yarns 622 to form a repeating pattern of first floats 628 in the first area 618. Although the repeating pattern of first floats 628 on the woven upper-body garment 600 are shown on an outer facing surface 650, based on the weaving pattern previously described, a repeating pattern of first floats is also located on an inner-facing surface of the woven upper-body garment 600 (not shown).

The first area 618 is further formed from a fourth plurality of non-grip weft yarns 626 (shown without hatching) that are also interlaced with the first plurality of warp yarns 622 to form a repeating pattern of fourth floats 630 in the first area 618. As previously described, the first area 618 is comprised of a greater percentage of grip weft yarns 620 as compared to the fourth plurality of non-grip weft yarns 626. Both the greater percentage of grip weft yarns 620 in the first area 618 and the repeating pattern of first floats 628 formed from the grip weft yarns 620 provide increased friction in the first area 618.

Additionally, the woven upper-body garment of FIG. 6 also comprises a second area 602 that is located on the front side 604 of the woven upper-body garment 600 inferior to the first area 618 and extending to, for instance, the waist opening 612 of the upper-body garment 600. The second area 602 is formed from a second plurality of non-grip weft yarns 624 (shown without hatching) interlaced with the first plurality of warp yarns 622. As mentioned, the second area 602 may be woven using a mock leno construction to provide greater air permeability for the second area 602 of the upper-body garment 600 as compared to, for instance, the first area 618.

Turning now to FIG. 7, the back side 702 of the woven upper-body garment 600 is shown. In FIG. 7, the first area 618 and a third area 704 located inferior to the first area 618 and extending inferiorly on the back side 702 of the upper-body garment 600 is depicted. The third area 704 is formed from a third plurality of non-grip weft yarns 708 (shown without hatching) interlaced with the first plurality of warp yarns 622.

Figure 8:
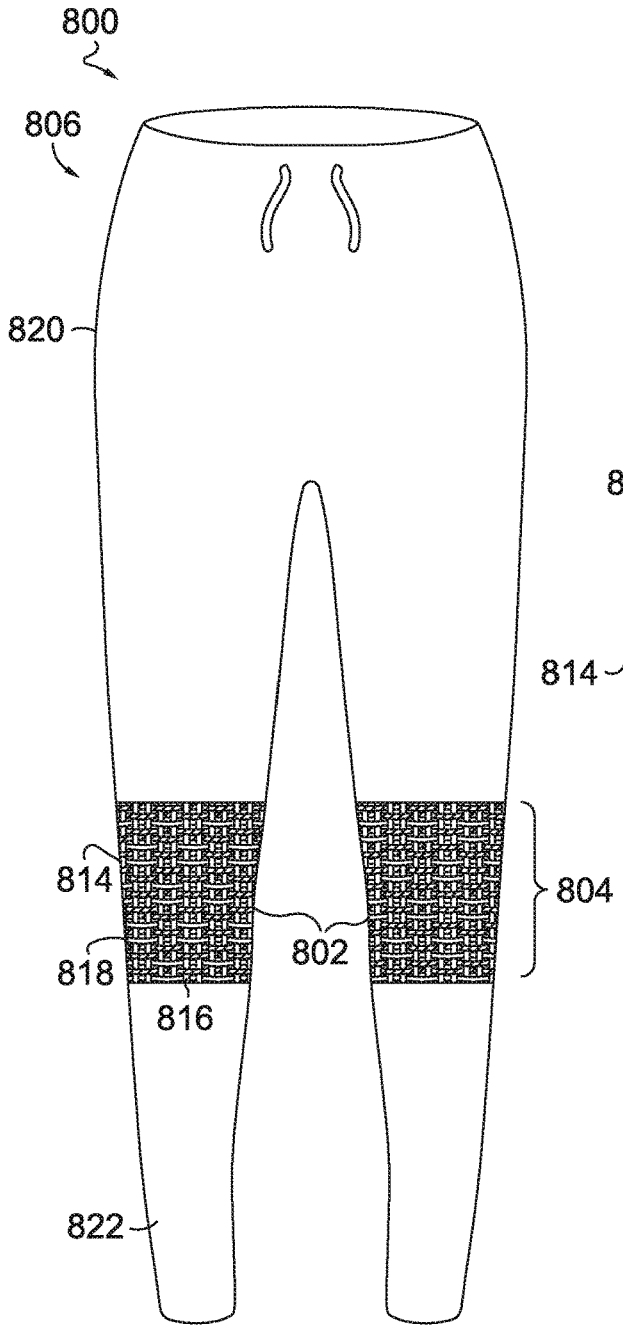
FIG. 8 illustrates a front view an of a woven lower-body garment having grip yarns in one or more predefined locations, in accordance with aspects herein.
Figure 9:
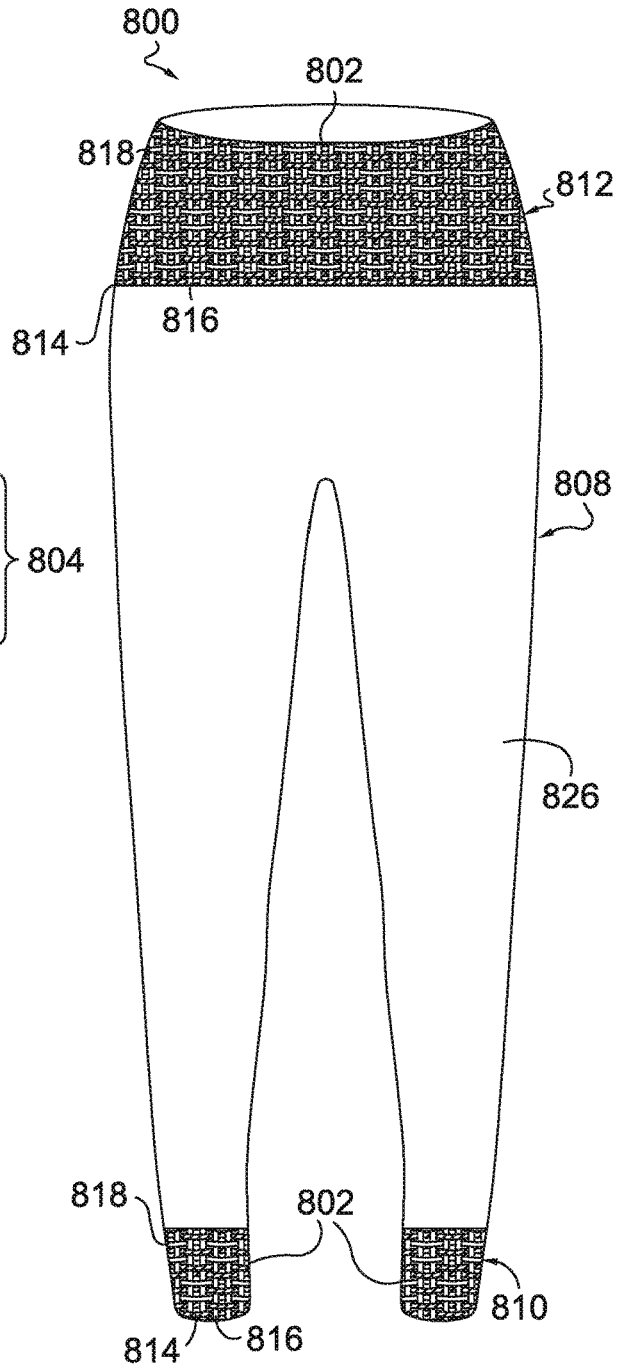
FIG. 9 illustrates a back view an of the lower-body garment of FIG. 8, in accordance with aspects herein.

FIGS. 8-9 illustrate front and back views of a lower-body garment 800 in accordance with aspects herein. In FIGS. 8-9, the lower-body garment 800 is depicted as a pair of athletic pants, although other types of lower-body garments are considered to be within the scope of this disclosure. For example, the lower-body garment 800 may be a pair of sweatpants or another type of athletic short. Alternatively, the lower-body garment 800 may be tailored specifically to one sport, such as a pair of football pants. Any and all types of lower-body garments are considered to be within the scope of this disclosure.

The woven lower-body garment 800 comprises a first area 802 seen around the knee region 804 on the front side 806 of the woven lower-body garment 800, the back lower waist/buttocks area 812, and back lower calf/ankle area 810. Each of these first areas 802, are comprised of a first plurality of grip weft yarns 814 interlaced with a first plurality of warp yarns 816. Further, the first areas 802 also comprise a fourth plurality of non-grip weft yarns 818 interlaced with the first plurality of warp yarns 816.

Additionally, the woven lower-body garment 800 seen in FIGS. 8-9 further comprises a second area 820, a third area 822, and a fourth area 826. In example aspects, the second area 820 may be formed from a second plurality of non-grip weft yarns (not shown) interlaced with the first plurality of warp yarns 816. The third area 822 may be formed from a third plurality of non-grip weft yarns (not shown) interlaced with the first plurality of warp yarns 816. The fourth area 826 found on the back side 808 of the woven lower-body garment 800 may be formed from a fifth plurality of non-grip weft yarns (not shown) interlaced with the first plurality of warp yarns 816.

The grip weft yarns 814 in the woven lower-body garment 800 are placed in areas that may require an increase in friction and grip. For example, the woven lower-body garment 800 shown may be yoga pants and as such, the placement of grip weft yarns 814 around the front knee area 804, lower back/buttocks area 812, and back lower calf/ankle area 810 may prevent slipping during different poses and transitional movements when worn by an individual practicing various yoga. The locations of the first areas 802 are examples only and it is contemplated herein that woven areas comprising grip weft yarns may be located in different areas depending on the end use of the particular garment. Any and all aspects, and any variation thereof, are contemplated as being within aspects herein.

Examples of the present invention have been described with the intent to be illustrative rather than restrictive. Alternative examples will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims.

What is claimed is:

1. A woven panel used to form an upper-body garment, the woven panel comprising:

a first surface and a second surface opposite the first surface;

a first area formed from a first plurality of weft yarns interlaced with a first plurality of warp yarns to form a repeating pattern of first floats on the first surface, the first plurality of weft yarns each having a denier per filament less than or equal to about 0.01;

a second area formed from a second plurality of weft yarns interlaced with the first plurality of warp yarns, the second plurality of weft yarns each having a denier per filament greater than about 0.01; and a third area formed from a third plurality of weft yarns interlaced with the first plurality of warp yarns, the third plurality of weft yarns each having a denier per filament greater than about 0.01, wherein the first area further comprises a fourth plurality of weft yarns interlaced with the first plurality of warp yarns, the fourth plurality of weft yarns each having a denier per filament greater than about 0.01 and wherein the first area comprises a greater percentage of the first plurality of weft yarns compared to the fourth plurality of weft yarns.

2. The woven panel of claim 1, wherein the first area is positioned between the second and the third area.

3. The woven panel of claim 2, wherein each of the first plurality of weft yarns extends over two warp yarns of the first plurality of warp yarns to form the repeating pattern of first floats on the first surface.

4. The woven panel of claim 3, wherein each of the fourth plurality of weft yarns extends over two warp yarns when interlaced with the first plurality of warp yarns in the first area.

5. The woven panel of claim 1, wherein the first plurality of warp yarns and the second plurality of weft yarns have a tenacity from about 8.9 grams/denier (g/d) to about 9.5 g/d.

6. A woven upper-body garment comprising:

a torso portion comprising a front side, a back side, a first sleeve opening, a second sleeve opening, a neck opening, and a waist opening;

a first sleeve extending from the first sleeve opening and a second sleeve extending from the second sleeve opening; and a first area located between the neck opening and the first and second sleeve openings, the first area formed from a first plurality of weft yarns interlaced with a first plurality of warp yarns to form a repeating pattern of first floats in the first area, the first plurality of weft yarns each having a denier per filament less than or equal to about 0.01;

a second area located on the front side of the woven upper-body garment formed from a second plurality of weft yarns interlaced with the first plurality of warp yarns, the second plurality of weft yarns each having a denier per filament greater than about 0.01; and a third area located on the back side of the woven upper-body garment formed from a third plurality of weft yarns interlaced with the first plurality of warp yarns, the third plurality of weft yarns each having a denier per filament greater than about 0.01, wherein the first area is further formed from a fourth plurality of weft yarns interlaced with the first plurality of warp yarns, the fourth plurality of weft yarns each having a denier per filament greater than about 0.01 and wherein the first area comprises a greater percentage of the first plurality of weft yarns compared to the fourth plurality of weft yarns.

7. The woven upper-body garment of claim 6, wherein the fourth plurality of weft yarns are interlaced with the first plurality of warp yarns to form a repeating pattern of fourth floats in the first area.

8. A garment formed from a woven panel, the garment comprising:

a first area formed from a first plurality of weft yarns interlaced with a first plurality of warp yarns to form a repeating pattern of first floats, the first plurality of weft yarns each having a denier per filament less than or equal to about 0.01;

a second area formed from a second plurality of weft yarns interlaced with the first plurality of warp yarns to form a repeating pattern of second floats in the second area, wherein the second plurality of weft yarns each have a denier per filament greater than about 0.01; and a third area formed from a third plurality of weft yarns interlaced with the first plurality of warp yarns, the third plurality of weft yarns each having a denier per filament greater than about 0.01, wherein the first area further comprises a fourth plurality of weft yarns interlaced with the first plurality of warp yarns, the fourth plurality of weft yarns each having a denier per filament greater than about 0.01 and wherein the first area comprises a greater percentage of the first plurality of weft yarns compared to the fourth plurality of weft yarns.

9. The garment of claim 8, wherein the repeating pattern of first floats are located on an inner-facing surface of the garment.

10. The garment of claim 8, wherein the repeating pattern of first floats are located on an outer-facing surface of the garment.

11. The garment of claim 8, wherein the first plurality of weft yarns comprises a polyethylene terephthalate yarn type.

12. The garment of claim 8, wherein the second plurality of weft yarns comprise one of polyamide yarns or polyethylene terephthalate yarns.

13. The garment of claim 8, wherein each of the first plurality of warp yarns each have a denier per filament greater than about 0.01.

* * * * *